US008166701B1

(12) United States Patent
Duff, Sr.

(10) Patent No.: US 8,166,701 B1
(45) Date of Patent: May 1, 2012

(54) ROTATING PLATFORM FOR POTTED PLANTS

(76) Inventor: Thomas A. Duff, Sr., Concord, MI (US)

( * ) Notice: Subject to any disclaimer, the term of this patent is extended or adjusted under 35 U.S.C. 154(b) by 369 days.

(21) Appl. No.: 12/454,980

(22) Filed: May 27, 2009

Related U.S. Application Data

(60) Provisional application No. 61/128,756, filed on May 27, 2008.

(51) Int. Cl.
*A47G 7/00* (2006.01)

(52) U.S. Cl. ..... 47/39

(58) Field of Classification Search ..... 47/39
See application file for complete search history.

(56) References Cited

U.S. PATENT DOCUMENTS

| | | | | |
|---|---|---|---|---|
| 1,479,618 | A | | 1/1924 | Mansbendel |
| 1,885,117 | A | | 11/1932 | Lemert |
| 3,360,885 | A | | 1/1968 | St. Clair |
| 4,017,725 | A | * | 4/1977 | Roen ..... 361/679.09 |
| 4,026,067 | A | | 5/1977 | Wengel |
| 4,051,627 | A | | 10/1977 | Schilling, Jr. |
| 4,227,343 | A | | 10/1980 | Espy et al. |
| 4,969,290 | A | | 11/1990 | Skoretz |
| 5,152,099 | A | | 10/1992 | Nilssen |
| 6,128,854 | A | | 10/2000 | Chaney |
| 6,230,440 | B1 | | 5/2001 | Deutsch |
| 6,557,297 | B2 | | 5/2003 | Receveur |
| 6,594,951 | B1 | * | 7/2003 | Reynolds ..... 47/39 |
| 6,604,321 | B2 | | 8/2003 | Marchildon |
| D479,776 | S | | 9/2003 | Rosenberg |

* cited by examiner

*Primary Examiner* — Monica Williams
(74) *Attorney, Agent, or Firm* — Montgomery Patent & Design, LLC; Robert C. Montgomery; Joseph T. Yaksich

(57) ABSTRACT

A rotating base for house plant planters is herein disclosed, wherein said base slowly turns to complete a revolution within a pre-determined period, to urge the plant in the planter to grow in a vertical direction. The planter base is powered by a battery which is charged using a solar panel, thereby providing a completely self-contained and maintenance free rotating base and a light sensor causing rotation of the planter base only when light is present. The planter base is available in multiple sizes to fit all sizes of pots and planters.

17 Claims, 6 Drawing Sheets

ROTATING PLATFORM FOR POTTED PLANTS

RELATED APPLICATIONS

The present invention was first described in and claims the benefit of U.S. Provisional Application No. 61/128,756, filed May 27, 2008, the entire disclosures of which are incorporated herein by reference.

FIELD OF THE INVENTION

The present invention relates generally to potted plant platforms, and more particularly, to an automatically rotating platform for potted plants.

BACKGROUND OF THE INVENTION

Plants and flowers are a welcome addition to any décor. Their vibrant colors combined with their unique physical traits and pleasant aromas often form the centerpiece of a home or garden. As with most living things, plants and flowers require attentive care for them to achieve their full potential. This of course includes many tasks, such as pruning, feeding and watering. One (1) additional common task is the manual rotation of the plant on a daily basis to prevent the plant from becoming permanently skewed due to growing towards the light. This movement of plants toward the light is called phototropism and is especially prevalent in plants that only have sunlight available from a single window on the interior of a dwelling. Phototropism is the result of a plant hormone that botanists have named auxin. Auxin is present in all green plants and has the peculiar characteristic of always moving away from the lighted side to cells on the shaded side of the plant. High concentrations of auxin cause stem cells to grow more rapidly and elongate and its absence causes cells to grow more slowly and shorten. This causes a stem to grow unevenly, the side away from the light grows more rapidly than the side toward the light and as a result, the stem begins to bend. As the stem bends, the plant curves toward the light. Since the sun regulates the schedule of plant growth, even if the plants are rotated on a daily basis, they can still have a skewed look and achieve an unhealthy growth pattern.

Various attempts have been made in the past to overcome this problem and provide turntables and other rotating display platforms for plants and flowers. These attempts can be seen by reference to the following U.S. Pat. Nos. 1,885,117, issued in the name of Lemert, which describes a revolving plant rack; 3,360,885, issued in the name of St. Clair, which describes a potted plant rotator; 4,969,290, issued in the name of Skoretz, which describes an apparatus for even exposure of plants to sunlight; and 6,128,854, issued in the name of Chaney, which describes a potted plant turntable. Other attempts to provide rotating display platforms and care for potted plants include U.S. Pat. Nos. 1,479,618; 4,026,067; 4,051,627; 4,227,343; 5,152,099; 6,230,440; and 6,604,321.

Additionally, ornamental designs for rotatable plant stands exist, particularly, U.S. Pat. No. D 479,776. However, none of these designs are similar to the present invention.

While these devices fulfill their respective, particular objectives, each of these references suffers from one (1) or more of the deficiencies and disadvantages by failing to provide a practical and efficient means of automatically rotating a potted plant which doesn't require regular attention and maintenance to be effective. Accordingly, there exists a need for a means by which house plants can be rotated on a continual basis to eliminate the tendency to grow towards the light. The development of the present invention substantially departs from the conventional solutions and in doing so fulfills this need.

SUMMARY OF THE INVENTION

In view of the foregoing references, the inventor recognized the aforementioned inherent problems and observed that there is a need for a platform for potted plants that provides a means for automatically rotating the plant so sunlight is evenly distributed, thus reducing the uneven growth ordinarily seen in indoor plants while also providing a decorative display platform and as such, the object of the present invention is to provide for this need.

To achieve the above objectives, it is an object of the present invention to provide a rotating base for potted house plants that slowly turns, such that the plant will grow straight due to the fact that it receives consistent light over its stem portion and does not has a chance to grow towards the light. The rotating base provides a completely self-contained and maintenance free means of plant rotation that is only active when light is present.

Another object of the rotating base for potted house plants is to provide an apparatus comprising a base, a lower pedestal, an upper pedestal, a solar panel, a battery, a height adjustment mechanism, and an internal rotary drive mechanism. The base comprises a plurality of legs and provides a decorative enclosure to internal electrical and electronic components including the rechargeable battery and the slidingly received solar panel power cell. A plurality of specially-shaped apertures is located around the base and provides a means to project light from internal lamps.

Yet still another object of the rotating base for potted house plants is to provide a base that is in mechanical communication with a lower pedestal portion via an internal drive mechanism that provides a rotary motion to the lower pedestal.

Yet still another object of the rotating base for potted house plants is to provide a lower pedestal that is in mechanical communication with an upper pedestal via a height adjustment mechanism that provides a stable height adjustable and rotating resting surface to the potted plant.

Yet still another object of the rotating base for potted house plants is to provide a slidingly attached solar power panel comprising a horizontal slide mechanism which engages the base and provides a means of housing the solar panel within the base when not needed and deploying the solar panel outwardly from the base to increase the available sunlight which can be obstructed near the base due to the hanging foliage of the plant.

Yet still another object of the rotating base for potted house plants is to provide an apparatus comprising a control module, a light sensor, a switch, a motor, and a motor shaft. The control module provides an electronic control means to all functional components which enables either manual or continuous automatic operation. The photoelectric light sensor is mounted along an outer surface of the base and provides an input signal to the control module halting the rotary motion of the platform during evening hours to conserve battery life. The multi-position switch provides an "ON/OFF" function and a selection of other particular functions which dictates the mode of operation.

Yet another object of the rotating base for potted house plants is to provide an apparatus comprising a variable speed control mechanism that provides a means to regulate the speed of rotation to the pedestals.

Yet another object of the rotating base for potted house plants is to provide an apparatus that comprises various sizes in order to fit different common sizes of pots and planters.

Yet still another object of the rotating base for potted house plants is to provide a method of utilizing the device that enables completely straight plant growth without the manual turning of plants away from the light in a unique and novel and manner.

Further objects and advantages of the rotating base for potted house plants will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols and in which:

| DESCRIPTIVE KEY | |
|---|---|
| 10 | rotating platform for potted plants |
| 19 | illumination |
| 20 | base |
| 21 | first aperture |
| 22 | second aperture |
| 23 | battery compartment |
| 23a | locking mechanism |
| 24 | leg |
| 25 | lower pedestal |
| 27 | fastener |
| 30 | upper pedestal |
| 35 | solar panel |
| 36 | slide mechanism |
| 37 | sliding motion |
| 38 | handle |
| 39 | foot |
| 40 | control module |
| 41 | sensor |
| 42 | wiring |
| 43 | lamp |
| 44 | motor |
| 45 | motor shaft |
| 46 | battery |
| 47 | switch |
| 48 | speed controller |
| 50 | height adjustment mechanism |
| 52 | height adjustment fastener |
| 54 | height adjustment fixed fastener |

-continued

| DESCRIPTIVE KEY | |
|---|---|
| 60 | rotary motion |
| 100 | planter |

DETAILED DESCRIPTION OF THE PREFERRED EMBODIMENT

Figure 1:
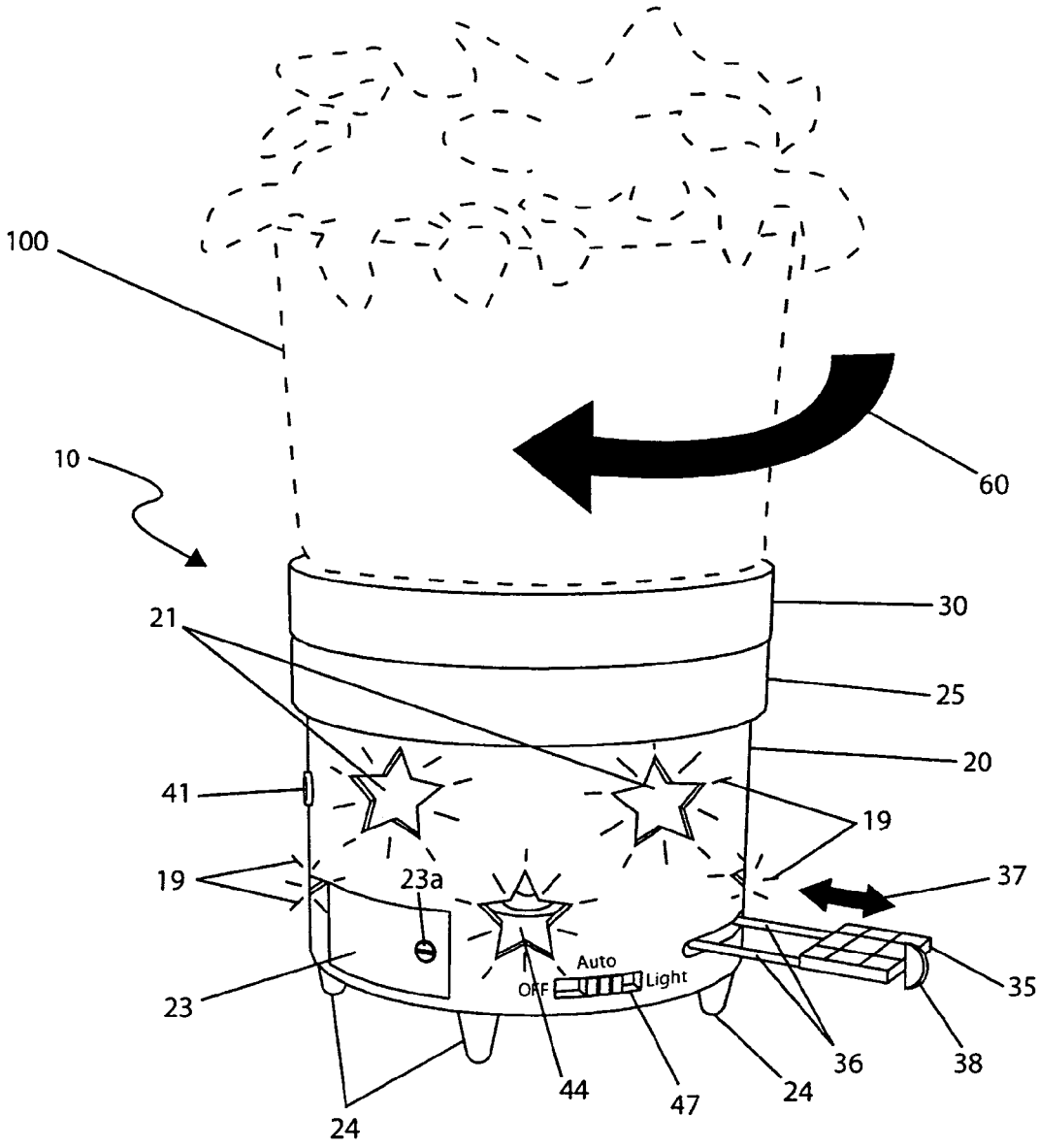
FIG. 1 is a perspective view of a rotating platform for potted plants 10 depicting a lowered upper pedestal portion 30, according to a preferred embodiment of the present invention.
Figure 2:
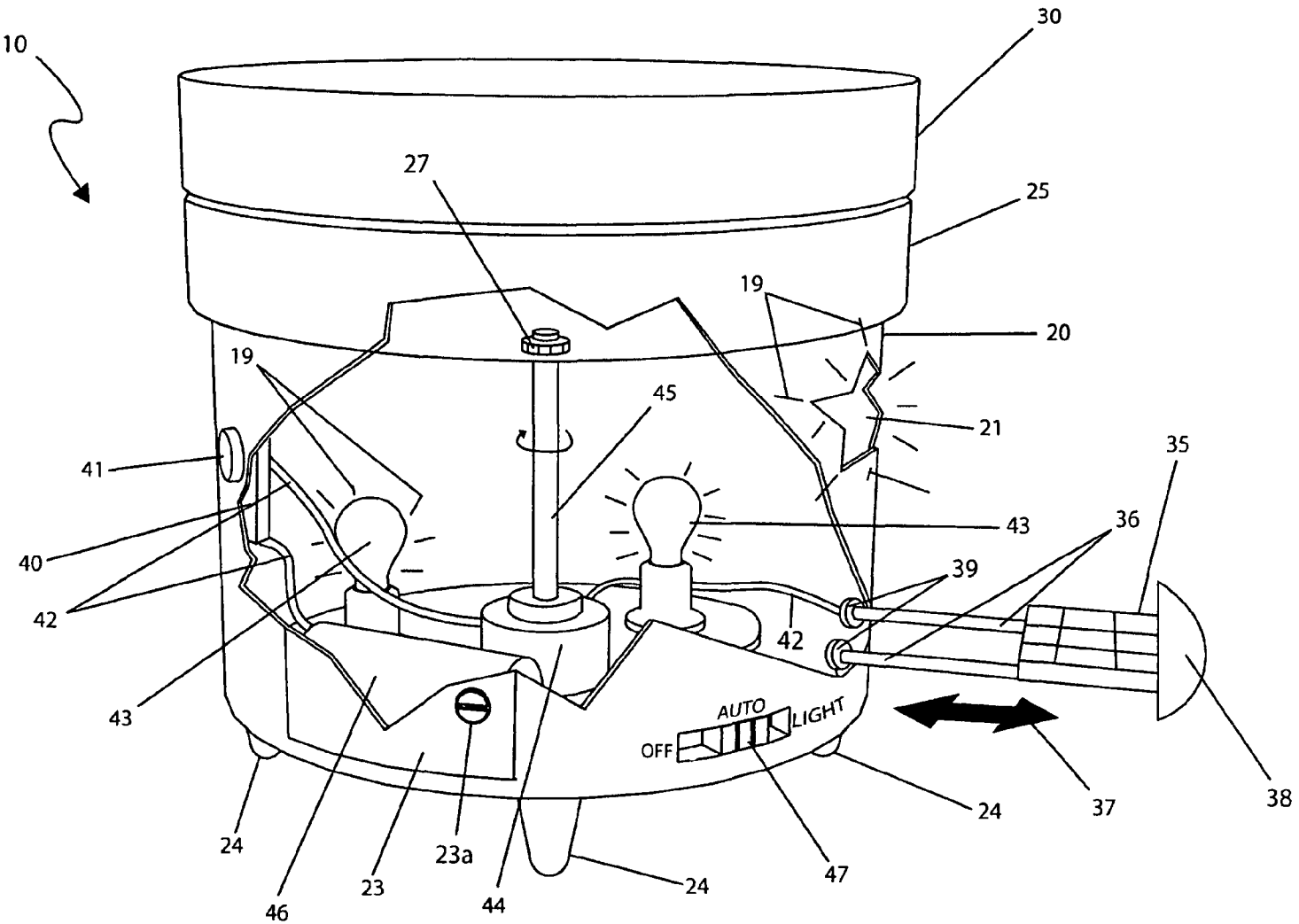
FIG. 2 is a cut-away view of a rotating platform for potted plants 10, according to a preferred embodiment of the present invention.
Figure 3:
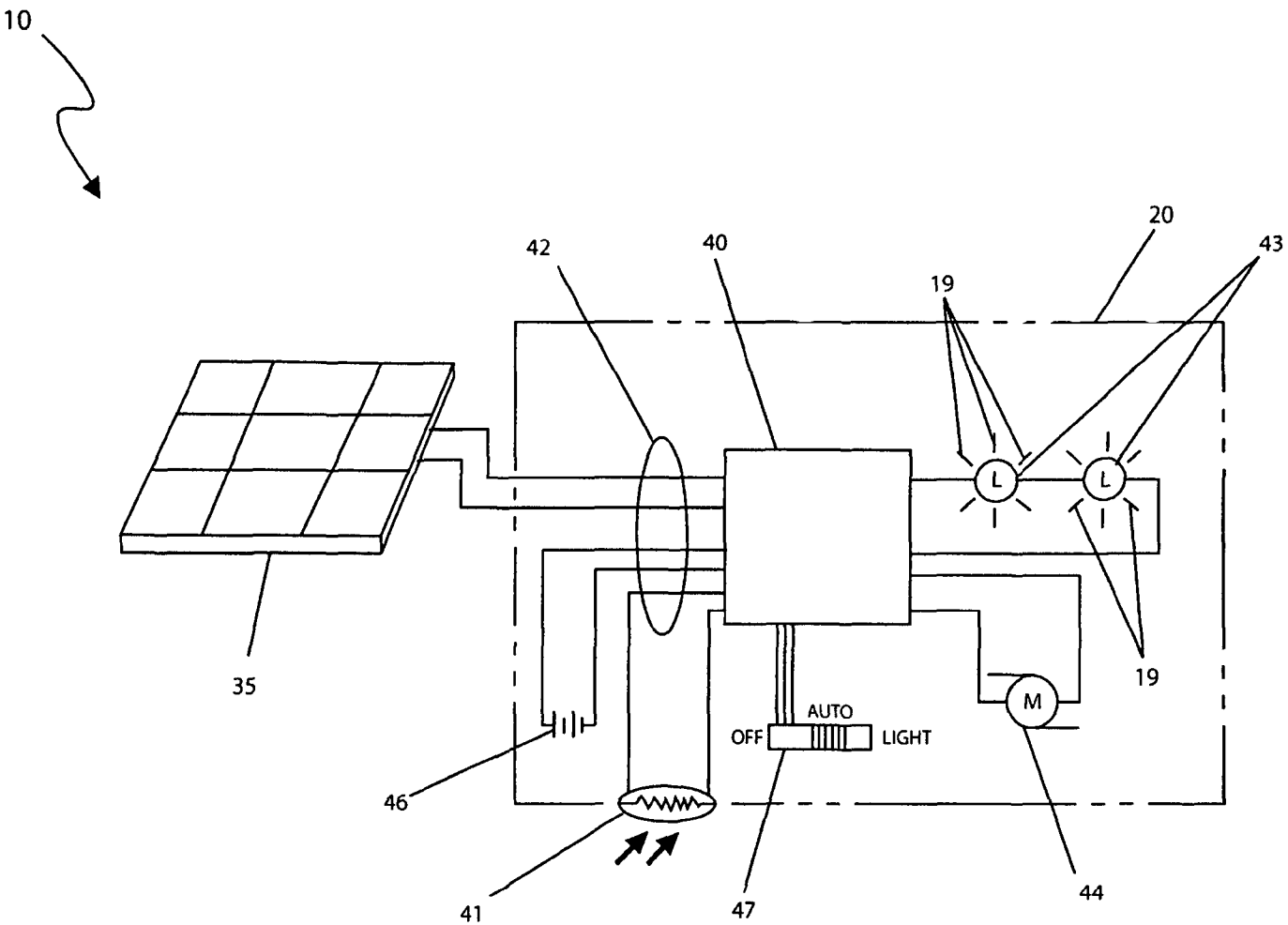
FIG. 3 is an electrical block diagram of a rotating platform for potted plants 10, according to a preferred embodiment of the present invention.
Figure 4:
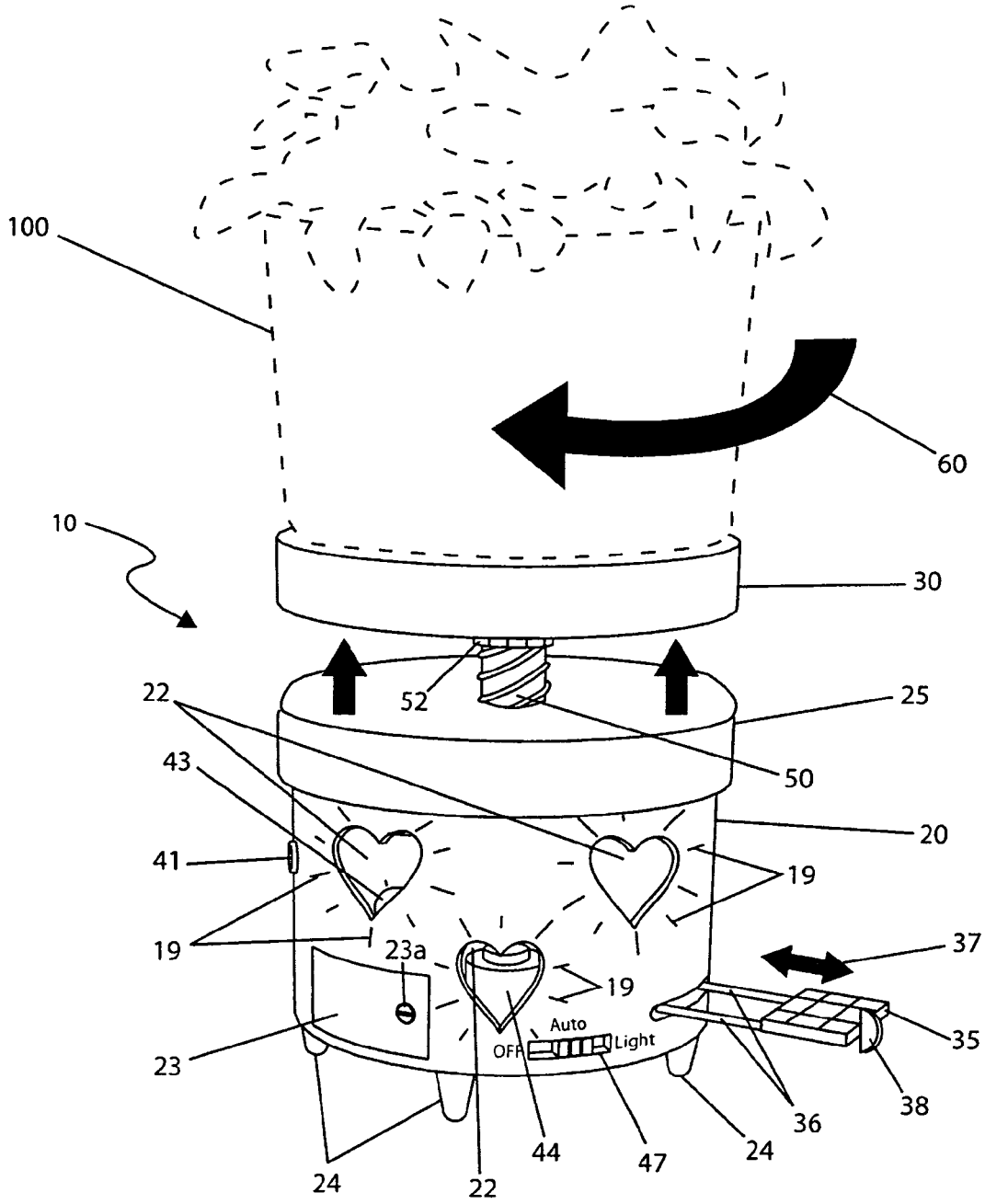
FIG. 4 is a perspective view of a rotating platform for potted plants 10 depicting a raised upper pedestal portion 30, according to an alternate embodiment of the present invention.
Figure 5:
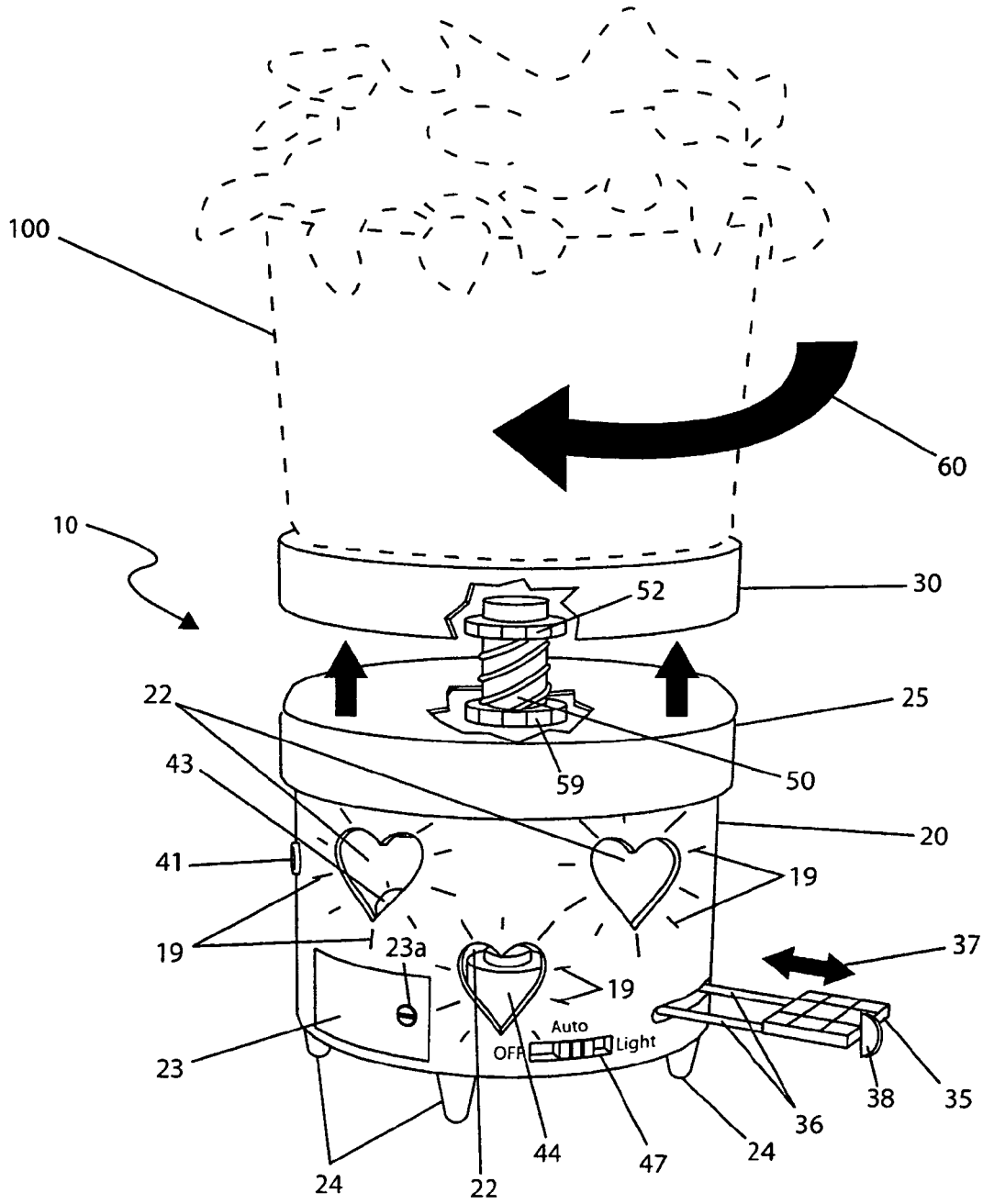
FIG. 5 is a perspective cut-away view of a rotating platform for potted plants 10, according to an alternate embodiment of the present invention; and, FIG. 6 is a perspective view of a rotating platform for potted plants 10 depicting a speed control 48, according to an alternate embodiment of the present invention.
Figure 6:
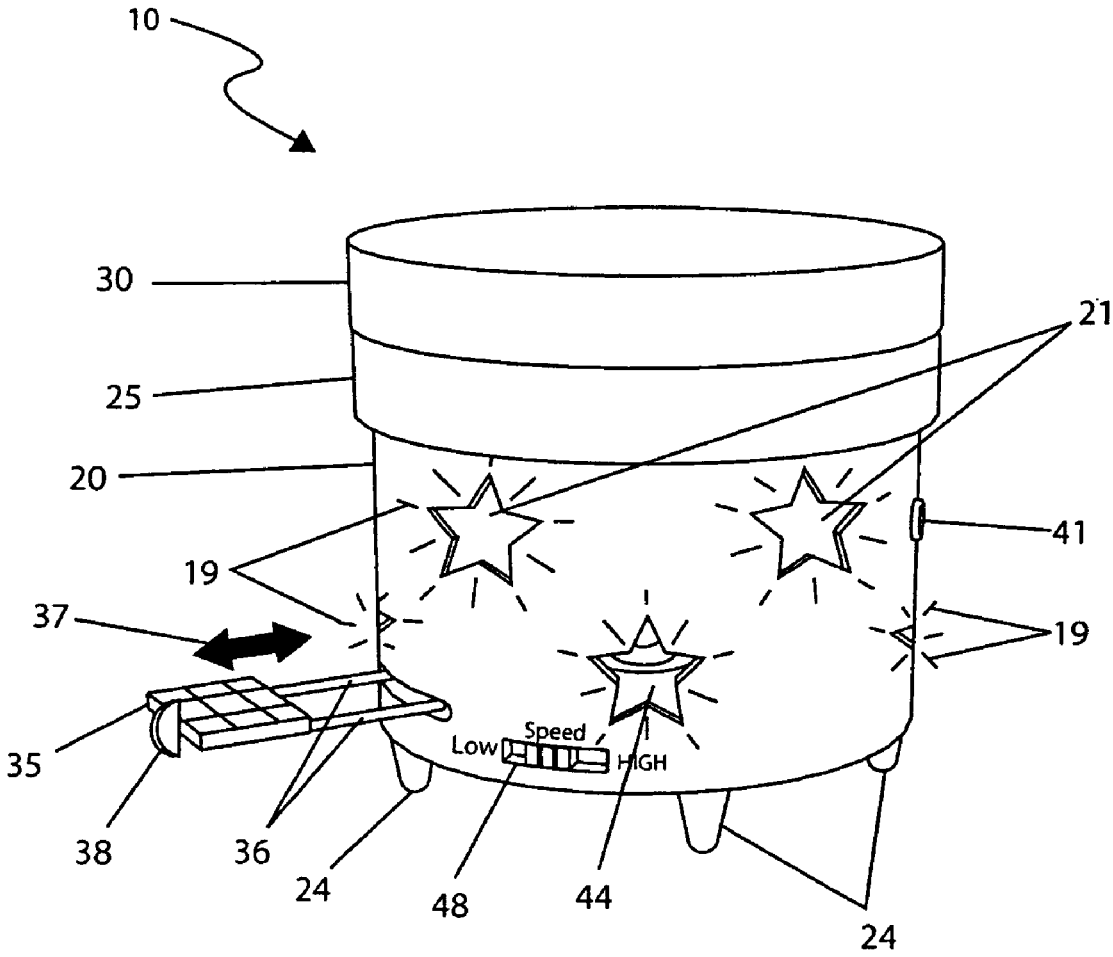

The best mode for carrying out the invention is presented in terms of its preferred embodiment, herein depicted within FIGS. 1 through 3 and alternately within FIGS. 4 through 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a rotating platform for potted plants (herein described as the "apparatus") 10. The planter 100 slowly turns such that a complete revolution takes at least twelve (12) hours. In such a manner, the plant contained in the planter 100 is enticed to grow straight due to the fact it does not have a chance to grow in one (1) direction towards a light source. The apparatus 10 receives electrical power via a solar panel 35 and a rechargeable battery 46. The apparatus 10 is provided in a completely self-contained and maintenance free form and only turns the planter 100 when light is present. Said apparatus 10 would be introduced in multiple sizes to fit different sizes of pots and planters 100.

Referring now to FIG. 1, a perspective view of the apparatus 10 depicting a lowered upper pedestal portion 30, according to the preferred embodiment of the present invention, is disclosed. The apparatus 10 comprises a base 20, a lower pedestal 25, an upper pedestal 30, a solar panel 35, and a slide 36. The base 20 provides a decorative enclosure thereto electrical and electronic components contained therewithin. The base 20 comprises a vertical cylinder-shaped structure approximately eight (8) inches in diameter and eight (8) inches high; however, it is understood that the apparatus 10 may be provided in a variety of heights and diameters corresponding to different size planters 100 and as such should not be interpreted as a limiting factor of the apparatus 10. The base 20 is fabricated from materials such as, but not limited to: sheet metal, molded plastic, or the like providing sturdy construction capable of supporting a weight of a planter 100 complete with soil, water, and expected vegetation. Furthermore, the base 20 is preferably introduced in a variety of decorative colors and patterns.

The base 20 further comprises a plurality of first apertures 21, a battery compartment 23, and a plurality of legs 24. The first apertures 21 provide a means to project light 19 therefrom internal lamps 43 located in the base 20 thereonto walls or other surroundings via specific aperture shapes 21. The apertures 21 comprise die-stamped shapes therein outer walls of the base 20. The apertures 21 may take on any number of shapes based upon a user's preference such as, but not limited to: hearts (see FIG. 4), alphanumeric characters, logos, animals, and the like.

The battery compartment 23 is illustrated here comprising an arcuate and flush-mount rectangular opening therealong a lower curved surface of the base 20 providing an access means thereto one (1) or more internal rechargeable batteries 46; however, the battery compartment 23 may be located at a number of positions thereupon the base 20, such as a bottom surface, and as such should not be interpreted as a limiting factor of the apparatus 10 (see FIG. 2). The battery compartment 23 also comprises a locking mechanism 23*a*, thereby securing said battery compartment 23 therein a closed position. The locking mechanism 23*a* is illustrated here as a conventional screw-type lock, yet it is known that other locking devices may be incorporated without limiting the functions of the apparatus 10.

The legs 24 comprise generally cylindrical plastic, metal, or wooden appendages extending therefrom the base 20 in a downward direction, thereby providing a stable and elevated contact therebetween the apparatus 10 and a flat surface such as, but not limited to: a tabletop, a desk area, or the like while being aesthetic in appearance. The legs 24 are securely affixed thereto a bottom surface of the base 20 using common fasteners or may also be integral thereto said base 20 being manufactured using processes such as injection-molding, welding, soldering, or the like. Furthermore, said legs 24 may be threadingly attached thereto the base 20 providing leveling or additional height adjustment means thereto the apparatus 10 upon a surface.

The base 20 is in mechanical communication therewith a lower pedestal portion 25 via internal drive mechanisms providing a rotary motion 60 thereto (see FIG. 2). The lower pedestal 25 comprises a flat round platen having a similar diameter as the base 20 being approximately one-half (½) to one (1) inch thick. The lower pedestal 25 is in further mechanical communication therewith an upper pedestal 30 via a height adjustment mechanism 50 (see FIG. 4). The upper pedestal 30 comprises a similar diameter and thickness as the lower pedestal 25 providing a stable height adjustable and rotating top surface thereto the planter 100. The lower 25 and upper 30 pedestals are fabricated from rugged materials such as, but not limited to: plastic, metal, wood, or the like.

The base 20 further provides a sliding attachment means 37 thereto a solar panel 35 via a horizontal slide mechanism 36. A distal portion of the solar panel 35 comprises a handle 38, thereby providing a digit-operated gripping means to deploy said solar panel 35 from the base 20 by means of the sliding mechanism 36. The handle 38 also prohibits the solar panel 35 from being inserted beyond a maximum depth, thereby engaging the surface of the base 20 when not operational. Said handle 38 is illustrated here as being an arcuate protrusion, yet other handles 38 may be provided without limiting the features of the apparatus 10. The solar panel 35 is preferably a common photovoltaic panel approximately four (4) inches square; however, an actual size and number of solar panels 35 is to correspond to the specific electrical power requirements of internal electrical components (see FIG. 2). Furthermore, a size of the solar panel 35 may vary based upon a particular size and model of the apparatus 10 and anticipated loading therefrom the planter 100. The slide mechanism 36 provides a sliding extension 37 means thereto the solar panel 35 providing improved reception of light beyond hanging foliage therefrom the planter 100. The slide 36 is illustrated here comprising a pair of parallel horizontal rods being directed toward a window or other light source; however, it is understood that the slide mechanism 36 may take on various forms and devices to improve light gathering capability and should not be interpreted as a limiting factor of the apparatus 10.

Referring now to FIG. 2, a cut-away view of the apparatus 10, according to a preferred embodiment of the present invention, is disclosed. The apparatus 10 comprises a fastener 27, a pair of feet 39, control module 40, a light sensor 41, interconnecting wiring 42, a pair of lamps 43, a motor 44, a motor shaft 45; and one (1) or more rechargeable batteries 46. A distal end portion of the slide mechanism 36 comprises a pair of feet 39, thereby prohibiting the solar panel 35 from being completely removed from the base 20. The feet 39 are integrally molded into the sliding mechanism 36 and allow wiring 42 to be inserted therein for controlling the solar panel 35 by means of the control module 40.

The control module 40 provides an electronic control means thereto the apparatus 10 allowing manual or continuous automatic operation. The control module 40 comprises a standard miniature plastic housing further comprising microprocessor based circuits and components including devices such as, but not limited to: input/output circuits, embedded software, solid-state relays, and the like, capable of providing power and control thereto a motor 44 and two (2) or more lamps 43 via common interconnecting wiring 42. Additionally, a photoelectric sensor 41 mounted along an outer surface of the base 20 provides an input signal thereto the control module 40, thereby halting the motor 44 and corresponding rotary motion 60 thereto the planter 100 during evening hours to conserve battery life 46.

A multi-position switch 47 provides an "ON/OFF" function as well as selection of particular functions of the apparatus 10. The switch 47 comprises a multi-position slide-type device providing approximately three (3) positions based upon specific desired functions; however other switching and indicating devices may be provided such as, but not limited to: a rotary selector dial, indicator lamps, momentary contact buttons, an electronic display, or the like, and as such should not be interpreted as a limiting factor of the apparatus 10. Said selected functions provide decorative and functional lighting 19 of a surrounding area via two (2) or more lamps 42 and a rotary motion 60 thereto the planter 100 via an internal direct current (DC) motor 44. The lamps 43 comprise two (2) or more common incandescent or light-emitting diode (LED) type devices, yet other illuminating devices may be incorporated without limiting the functions of the apparatus 10. The base 20 provides a replacement and access means thereto the lamps 43 along a bottom surface thereof using attachment means such as, but not limited to: locking flanges, bayonet mounts, threaded sockets, or the like, thereby allowing a user to easily install bulbs 43 having different characteristics such as, but not limited to: color, brightness, and the like, thereby creating various desired lighting effects 19.

The motor 44 is a miniature direct current (DC) unit comprising an integral gear reducer capable of generating a rotary motion 60 thereto an output shaft 45 which in turn extends in an upward direction being in mechanical communication therewith the lower pedestal 25. Said output shaft 45 is connected to the lower pedestal 25 therewith a fastener 27, thereby securing the lower pedestal 25 to the shaft 45 and enabling rotation of said lower pedestal 25. The fastener 27 is preferably a conventional washer, yet other fastening means may be provided without limiting the functions of the apparatus 10. The motor system 44 is designed so as to result in one (1) revolution of the planter 100 approximately every twelve (12) hours, thereby resulting in a healthy plant growth pattern.

The battery compartment 23 provides a convenient access means thereto one (1) or more internal rechargeable batteries 46 which are capable of repeated cycling and being made using battery technologies such as, but not limited to: nickel cadmium (NiCd), nickel metal hydride (NiMH), lithium ion (Li-ion), or other current battery technologies.

Referring now to FIG. 3, an electrical block diagram of the apparatus 10, according to a preferred embodiment of the present invention, is disclosed. The base portion 20 of the apparatus 10 provides an attachment means thereto internal motion and controlling equipment providing automatic operation of the apparatus 10. A current is supplied therefrom rechargeable batteries 46 thereto the microprocessor based control module 40. The control module 40 provides intelligent management of input and output signals to initiate desired automatic functions. Particular input signals are conducted thereto said control module 40 via common copper wiring 42 including a selector switch 47, thereby providing a mode selection means and a light sensor 41 to detect daylight hours. In turn, particular output currents are provided in response thereto embedded software therewithin the control module 40 thereto the motor 44 and lamps 43.

The multi-position switch 47 provides selection of modes including, but not limited to: an "OFF" function to cut power thereto the motor 44 and lamps 43, an "AUTO" function allowing continuous automatic operation of the motor portion 44 during daylight hours, and a "LIGHT" function which adds illuminated projection of light 19 therefrom internal lamps 43. The rotary motion 60 of the planter 100 takes place exclusively during daylight hours as detected by the light sensor 41. The light sensor 41 comprises a common photoelectric device capable of detecting ambient light and conducting an input signal thereto the control module 40 to initiate the motor function 44. Additionally, the control module 40 provides a battery charging function by regulating a received electrical current therefrom the solar panel 35 thereto the rechargeable batteries 46. Charging of said batteries 46 is on a continual basis whenever light is received by the solar panel 35, regardless of selected functions.

Referring now to FIG. 4, a perspective view of the apparatus 10 depicting a raised upper pedestal portion 30 and FIG. 5, a perspective cut-away view of the apparatus 10, according to an alternate embodiment of the present invention, are disclosed. The apparatus 10 may alternatively comprise a height adjustment mechanism 50. The height adjustment mechanism 50 provides a means to adjust a gap therebetween the lower 25 and upper 30 pedestals to approximately two (2) to six (6) inches, thereby compensating for hanging foliage portions of a plant therewithin the planter 100 over a period of time. The height adjustable mechanism 50 is illustrated here being a sturdy threaded shaft being stationarily mounted or molded thereto the lower pedestal 25 therewith a height adjustment fixed fastener 54 and threadingly engaged therewithin the upper pedestal 30 therewith a height adjustment fastener 52. The height adjustment fixed fastener 54 is preferably a conventional washer which is welded to the height adjustment mechanism 50 and the height adjustment fastener 52 is preferably a convention lock washer yet other fastening means may be incorporated without limiting the functions of the apparatus 10. Manual rotation of the upper pedestal 30 in a counter-clockwise direction in relation thereto the lower pedestal 25 results in an elevation of said upper pedestal 30 and the accompanying planter 100 with regards to a tabletop surface or other supporting structure. It is understood however, that the height adjustment mechanism 50 may be introduced having various designs to provide a height adjustment function such as rotary friction devices, spring loaded pins, or the like, without deviating from the concept and as such should not be interpreted as a limiting factor of the apparatus 10.

Referring now to FIG. 6, a perspective view of the apparatus 10 depicting a speed control 48, according to an alternate embodiment of the present invention, is disclosed. Alternatively, the motor 44 may further comprise a variable speed controller 48 to set a particular upper pedestal 30 rotational speed. Preferably, the variable speed controller 48 would be located thereon the base 20 of the apparatus 10, thereby supplying a digit-operated switching device, similar to the abovementioned switch 47. Said speed controller 48 provides selection of modes including, but not limited to: a "LOW" function to slow the speed of the motor 44 and increasing to a "HIGH" function to intensify the speed of the motor 44. Other similar settings may also be providing without limiting the functions of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of utilizing the apparatus 10 may be achieved by performing the following steps: procuring a particular model of the apparatus 10 which is suitable to a particular weight and size of an anticipated planter 100 to be applied thereto the apparatus 10; installing lamps 43 having desired decorative lighting 19 such as those based upon color and brightness, if not previously installed; placing the apparatus 10 upon a flat surface such as a table, desk, or the like; positioning the apparatus 10 such that the solar panel 35 adjacent to a light source; slidably extending 37 the solar panel 35 using the panel slide mechanism 36, as required; placing a planter 100 and occupying plant thereupon the upper pedestal 30; adjusting a height of the planter 100 by rotating the height adjustment mechanism 50, as desired; charging the rechargeable batteries 46 by exposing the solar panel 35 to a light source for a period of time; selecting an "AUTO" mode thereupon the switch 47, thereby initiating a rotary motion 60 thereto an occupying planter 100 during daylight hours as detected by the sensor 41; or selecting a "LIGHT" mode to additionally provide decorative lighting 19 thereto a surrounding area via the internal lamps 43 and the apertures 21, 22; sliding the speed controller 48 thereto increase or decrease the speed of the motor 44, as desired; sliding the switch 47 to an "OFF" position to cease operation of the motor 44 and lamp 43 functions while allowing the batteries 46 to continue to charge; and, benefiting from improved plant health due to more uniform growth patterns resulting from the rotary motion 60 of the apparatus 10 as well as enjoying the decorative appearance and creative lighting effects afforded a user of the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A platform for supporting a potted plant, comprising:

a base;

an upper pedestal adjustably attached thereto said lower pedestal;

an illumination means enclosed within said base; and, a control mechanism in electrical communication therewith said rotating means and said illumination means;

wherein said platform provides a means to automatically rotate said potted plant resting thereon said upper pedestal to provide an even distribution of sunlight controlled thereby said control mechanism;

wherein said platform provides a means for plant growth;

wherein said platform comprises a height adjustment means thereof said upper pedestal with respect thereto said lower pedestal;

wherein said illumination means provides illumination controlled thereby said control mechanism; and, wherein said platform provides an aesthetic display therefor said potted plant, wherein said lower pedestal and said upper pedestal each further comprise a flat round platen having a substantially identical diameter as said base;

wherein said upper pedestal comprises a stable height adjustable and rotating top surface thereto said potted plant, wherein said power source further comprises a solar panel;

a slide mechanism, comprising a pair of parallel rods each attached at a proximal end thereto said solar panel, thereby enabling said solar panel to be slidably engaged therewith said base, said slide mechanism comprises a pair of parallel rods;

a pair of feet connecting to a distal end of each of said pair of parallel rods, thereby prohibiting said solar panel from being completely removed therefrom said base, said pair of feet providing a routing means therefor electrical wiring therefor said solar panel thereto said control module; and, a handle located thereat a distal end thereof said solar panel;

wherein said handle provides a gripping means to deploy said solar panel therefrom said base and prohibits said solar panel from being inserted beyond a maximum depth, wherein said slide mechanism provides an improved reception of light therefor said solar panel.

2. The platform of claim 1, wherein said base further comprises a vertical cylindrical structure with an interior enclosing said rotating means and a plurality of legs to provide support therefor said platform.

3. The platform of claim 1, wherein said base further comprises a plurality of decorative apertures, thereby providing an aesthetic means for projecting illumination therefrom said illumination means.

4. The platform of claim 1, wherein said rotating means further comprises a motor controlled thereby said control mechanism comprising an integral gear reducer capable of generating a rotary motion thereto an output shaft extending in an upward direction and affixed thereto a bottom surface thereof said lower pedestal;

wherein said motor rotates said output shaft which in turn rotates said lower pedestal and said upper pedestal.

5. The platform of claim 1, wherein said height adjustment means further comprises a threaded shaft affixed thereto said lower pedestal therewith a height adjustment fixed fastener and threadingly engaging said upper pedestal therewith a height adjustment fastener.

6. The platform of claim 1, wherein said illumination means further comprises a plurality of lamps internally mounted thereto said base.

7. The platform of claim 1, wherein said control mechanism further comprises:

a power source;

a microprocessor-based control module receiving power therefrom said power source, providing a control means thereto said platform, comprising a standard housing mounted therein said base;

a light sensor in electronic communication therewith said control module mounted along an outer surface thereof said base; and, a selector switch in electronic communication therewith said control module located thereon an outer surface thereof said base;

wherein said light sensor provides operation thereto said control module upon sensing light;

wherein said control module provides management of input and output signals to initiate selected functions.

8. The platform of claim 1, wherein said power source further comprises at least one (1) rechargeable battery housed therewithin a flush-mounted battery housing thereon said base and secured with a locking means;

wherein said control module provides a battery charging function by regulating a received electrical current therefrom said solar panel thereto said at least one (1) rechargeable battery.

9. The platform of claim 7, wherein said selector switch further comprises a multi-position switch thereby providing a selectable function thereto said platform, further comprising:

an "ON" function for supplying power therefrom said power source thereto said platform;

an "OFF" function for restricting power therefrom said power source thereto said platform;

an "AUTO" function initiating said light sensor to provide control thereto said rotating means, thereby allowing continuous automatic operation of said rotating means when said light sensor senses light; and, a "LIGHT" function thereby initiating said illumination means;

wherein said rotating means provides a rotary motion therefor said platform for a pre-determined period.

10. The platform of claim 9, wherein said pre-determined period comprises one (1) revolution every twelve (12) hours.

11. The platform of claim 7, further comprising a variable speed control switch adjacent thereto said selector switch enabling said pre-determined period to be selectively set to a desired period between a "LOW" setting and a "HIGH" setting.

12. A platform for supporting a potted plant, comprising:

a base, comprising a vertical cylindrical structure with an interior enclosing said rotating means and a plurality of legs to provide support therefor said platform;

a lower pedestal rotatably attached thereto said base, comprising a flat round platen having a similar diameter as said base;

an upper pedestal adjustably attached thereto said lower pedestal therewith a height adjustment means, comprising a flat round platen having a similar diameter as said base;

a rotating means, comprising a motor comprising an integral gear reducer capable of generating a rotary motion thereto an output shaft extending in an upward direction and affixed thereto a bottom surface thereof said lower pedestal;

an illumination means comprising a plurality of lamps internally mounted thereto said base; and, a control mechanism in electrical communication therewith said rotating means and said illumination means, further comprising: a power source; a microprocessor-based control module receiving power therefrom said power source, providing a control means thereto said platform, comprising a standard housing mounted therein said base;

a light sensor in electronic communication therewith said control module mounted along an outer surface thereof said base, thereby providing operation thereto said control module upon sensing light; and, a selector switch in electronic communication therewith said control module, comprising a multi-position switch located thereon an outer surface thereof said base, thereby providing a selectable function thereto said platform, further comprising:

an "ON" function for supplying power therefrom said power source thereto said platform;

an "OFF" function for restricting power therefrom said power source thereto said platform;

an "AUTO" function initiating said light sensor to provide control thereto said rotating means, thereby allowing continuous automatic operation of said rotating means when said light sensor senses light; and, a "LIGHT" function thereby initiating said illumination means; wherein said platform provides a means to automatically rotate said potted plant resting thereon said upper pedestal to provide an even distribution of sunlight controlled thereby said control mechanism for a pre-determined period;

wherein said upper pedestal comprises a stable height adjustable and rotating top surface thereto said potted plant;

wherein said platform provides a means for plant growth;

wherein said platform comprises a height adjustment means thereof said upper pedestal with respect thereto said lower pedestal;

wherein said illumination means provides illumination controlled thereby said control mechanism; and, wherein said platform provides an aesthetic display therefor said potted plant, wherein said power source further comprises:

a solar panel;

a slide mechanism, comprising a pair of parallel rods each attached at a proximal end thereto said solar panel, thereby enabling said solar panel to be slidably engaged therewith said base, said slide mechanism comprises a pair of parallel rods;

a pair of feet connecting to a distal end of each of said pair of parallel rods, thereby prohibiting said solar panel from being completely removed therefrom said base, said pair of feet providing a routing means therefor electrical wiring therefor said solar panel thereto said control module; and, a handle located thereat a distal end thereof said solar panel;

wherein said handle provides a gripping means to deploy said solar panel therefrom said base and prohibits said solar panel from being inserted beyond a maximum depth, wherein said slide mechanism provides an improved reception of light therefor said solar panel.

13. The platform of claim 12, wherein said base further comprises a plurality of decorative apertures, thereby providing an aesthetic means for projecting illumination therefrom said illumination means.

14. The platform of claim 12, wherein said height adjustment means further comprises a threaded shaft affixed thereto said lower pedestal therewith a height adjustment fixed fastener and threadingly engaging said upper pedestal therewith a height adjustment fastener.

15. The platform of claim 12, wherein said power source further comprises at least one (1) rechargeable battery housed therewithin a flush-mounted battery housing thereon said base and secured with a locking means;

wherein said control module provides a battery charging function by regulating a received electrical current therefrom said solar panel thereto said at least one (1) rechargeable battery.

16. The platform of claim 15, further comprising a variable speed control switch adjacent thereto said selector switch enabling said pre-determined period to be selectively set to a desired period between a "LOW" setting and a "HIGH" setting.

17. The platform of claim 15, wherein said pre-determined period comprises one (1) revolution every twelve (12) hours.

* * * * *